US007121047B2

(12) United States Patent
Quinn

(10) Patent No.: US 7,121,047 B2
(45) Date of Patent: Oct. 17, 2006

(54) FLASHING ASSEMBLY

(75) Inventor: Jerry Joseph Quinn, Pataskala, OH (US)

(73) Assignee: StepFast, Ltd., Pataskala, OH (US)

( * ) Notice: Subject to any disclaimer, the term of this patent is extended or adjusted under 35 U.S.C. 154(b) by 0 days.

(21) Appl. No.: 09/854,891

(22) Filed: May 14, 2001

(65) Prior Publication Data

US 2002/0166292 A1 Nov. 14, 2002

(51) Int. Cl.
*E04D 1/36* (2006.01)

(52) U.S. Cl. ..... 52/60; 52/58; 52/13

(58) Field of Classification Search ..... 52/60, 52/105, 287.1, 288.1, 519, 520, 522, 536, 52/13, 276; 403/279, 282, 283
See application file for complete search history.

(56) References Cited

U.S. PATENT DOCUMENTS

| | | | | |
|---|---|---|---|---|
| 2,254,558 | A * | 9/1941 | Williams | 403/274 |
| 3,698,142 | A * | 10/1972 | Theriault | 52/556 |
| 3,934,327 | A * | 1/1976 | Hafner | 29/432 |
| 4,594,818 | A | 6/1986 | Prestidge | |
| 4,648,218 | A * | 3/1987 | Butzen | 52/96 |
| 4,658,502 | A * | 4/1987 | Eckold et al. | 29/798 |
| 4,736,565 | A * | 4/1988 | Bisson | 52/526 |
| 4,897,912 | A * | 2/1990 | Slasinski | 29/432.2 |
| 4,951,431 | A | 8/1990 | Sweers | |

(Continued)

*Primary Examiner*—Robert Canfield
(74) *Attorney, Agent, or Firm*—Stevens, Davis, Miller & Mosher LLP

(57) ABSTRACT

A flashing assembly that incorporates a plurality of overlapping flashing sections that are each preferably formed from a sheet material. Each section includes opposite edge portions that are arranged about a generally V-shaped configuration. Joining the sections together is at least one clinch joint that is substantially formed and registered upon the overlapping edge portions of at least two different overlapping flashing sections. The clinch joint is adapted to releasably fasten the at least two sections. Various modifications include one or more additional clinch joints that are also substantially formed upon the same overlapping edge portions of the first clinch joint and the V-shaped configuration that forms an angle of approximately 90 degrees. In other variations of the preceding modifications, the clinch joint is a mechanical press fit interference joint or a welded, press fit, or adhesive joint, or some combination or permutation thereof. Each section may also incorporate one or more attachment holes and alignment indicia. The sheet material is preferably selected from a material such as, for example, powdered, machined, drawn, stamped, rolled, extruded, and forged metals and plastics, and alloys, and combinations, mixtures, compositions, hybrids, tempers, hardness modified, and heat treated variations thereof. More preferably, the sheet material is selected from the group of materials including weather and galvanic corrosion resistant materials including, for example, aluminum, tin, bronze, copper, lead, stainless steel, galvanized metals, weather proofed metals, plastic coated metals, and alloys, combinations, mixtures, compositions, hybrids, tempers, surface treated, hardness modified, and heat treated variations thereof.

27 Claims, 3 Drawing Sheets

U.S. PATENT DOCUMENTS 5,115,603 A * 5/1992 Blair ..... 52/13
5,155,897 A * 10/1992 Schleicher ..... 29/509
5,208,973 A * 5/1993 Sawdon ..... 29/798
5,222,335 A * 6/1993 Petrecca ..... 52/105
5,305,517 A * 4/1994 Schleicher ..... 29/798
5,315,743 A * 5/1994 Schleicher ..... 29/243.5
5,337,526 A * 8/1994 Hartman ..... 52/518
5,605,019 A * 2/1997 Maziekien et al. ..... 52/58
5,621,961 A * 4/1997 Schleicher ..... 29/509
5,894,697 A * 4/1999 Hunter ..... 52/58
5,946,862 A * 9/1999 Hoffman ..... 52/58
5,984,563 A * 11/1999 Wu ..... 403/282
6,205,640 B1 * 3/2001 Dubugnon ..... 29/522.1
6,237,288 B1 * 5/2001 Jenkins et al. ..... 428/41.8
6,457,279 B1 * 10/2002 Jacobsen et al. ..... 52/58

* cited by examiner

FLASHING ASSEMBLY

TECHNICAL FIELD

This invention relates to a flashing assembly and method for use and manufacture, which is adapted for use in industrial, commercial, and residential roofing applications.

BACKGROUND OF THE INVENTION

In the construction industry, a wide variety of roofing applications in the commercial, industrial, and residential construction industries has led to the need to flashing devices and materials that are needed to protect such structures from the elements such as water, ice, and dust, and other weather and environment related problems that can create leaks in the roofs and damage to the structures. For example and with reference to FIG. 1, in nearly every roofing application, there is a need to seal the joint that is created between the generally planar roof "R" and any vertically extending structures such as dormers (not shown), chimneys C, and vertically projecting stories S that are elevated from any level of the roof R.

As a further example, the house H includes several intersections at such joints that are labeled generally by reference letter "I". In the past, various types of flashing devices have been used to form a water, ice, insect, and dust proof seal between whatever type of roofing material is used and the vertically projecting structure. With reference next generally to FIG. 2, such flashing devices typically are used to create a downwardly projecting channel wherein a vertically projecting portion of the flashing device is attached and sealed against the vertical projecting structure, such a chimney C, and the roofing material, such as shingles S that are attached to the generally planar roof R.

One such attempt at creating an improved flashing strip is described generally in U.S. Pat. No. 5,337,526 to Hartman. The Hartman '526 patent is limited to a flashing strip that includes a spacer that is positioned to create a space between flashing segments, which are permanently joined together for attachment to a roof. Another attempt at a new flashing strip is described by Hoffman in U.S. Pat. No. 5,946,862, which is restricted to a flashing strip that includes flashing cards that are permanently joined together by adhesive or staples. One of the various problems with these types of flashing strips is that when an end of the intersection is reached, the strip must be cut. This creates a significant amount of waste material since the unused portion may not be later used at another intersection on the roof. Additionally, these types of flashing strips incorporate a troublesome interstice within the vertical projecting portion of the individual flashing cards and segments that must either be sealed with an added sealant, such as tar or chalk, or else be subject to creating leaks in the roof and spaces for liquid water to accumulate, which can freeze and create unexpected separation of the individual cards and segments.

In all such applications, there has long been a need to provide the roofer with an easy to use, inexpensive, and convenient means for not only installing and handling such roofing materials, such as, for example, flashing, but also for employing the materials with a minimum of waste and the most possible flexibility in use. It has also been important for an improvement to be had that reduces if not eliminates the need to additional sealing materials to be used to seal the spaces between the individual pieces of flashing, such as the cards and segments described by Hoffman and Hartman. Moreover, what has been needed and heretofor unavailable is a flashing device that minimizes the waste otherwise attributable to use of devices similar to those described in the prior art.

In each of the noted applications and situations, cumbersome and time-consuming devices like those in the prior are generally undesirable. Some attempts have been made to address the need for an improved means for storing, handling, and installing roofing materials such as flashing, but none have been able to achieve the capabilities afforded by the present invention. What has been needed but heretofore unavailable, is an apparatus that not only easily accommodates a wide variety of roof flashing applications, but which can also be adapted without undue burden to facilitate reduced waste materials and a lessened need for application of post-flashing installation sealants.

The present invention meets these and other needs without adding any complexity, inefficiencies, or significant costs to roof flashing applications. The various embodiments of the present invention disclosed herein are readily adapted for ease of manufacture, low fabrication costs, and immediate compatibility with both the presently known roof flashing applications and building materials presently in use.

SUMMARY OF INVENTION

In its most general sense the present invention overcomes the shortcomings of the prior art in any of a number of generally effective configurations. In one of its embodiments, this invention includes a flashing assembly fabricated from a plurality of overlapping flashing sections. Each of the sections is preferably formed from a sheet material. Each section is further formed to have opposite edge portions. The opposing edge portions are preferably arranged about the flashing section to establish a generally V-shaped configuration. Preferably, the V-shaped configuration is formed to have an inside angle that is between approximately 45 and 135 degrees, and is more preferably between approximately 60 degrees 120, and is most preferably approximately 90 degrees.

In the flashing assembly, the sections are joined together by at least one clinch joint that is substantially formed upon the overlapping edge portions of at least two different overlapping flashing sections. During formation of the clinch joint, a different overlapping edge portion of the respective flashing sections are registered over one another to form the overlapping arrangement of edge portions. While the different, respective edge portions are maintained in the overlapping relationship with one another, the clinch joint is then formed as described in more detail below. The clinch joint is preferably adapted to releasably fasten the at least two sections together, while positively retaining the respective flashing section together until forcibly released by a user or installer of the flashing assembly.

Various modifications of the above-described flashing assembly embodiment further may preferably include one or more additional clinch joints, which are also substantially formed and registered upon the same overlapping edge portions of the first clinch joint. Yet more variations of the preceding embodiments may further include one or more attachment holes and alignment indicia, if deemed to be useful for certain types of applications.

In other variations of the preceding modifications, the clinch joint is preferably a press fit joint as described by U.S. Pat. No. 5,115,897. Preferably, the clinch joint is formed to have an exterior mushroom-type head formed in a first of the respective edge portions, that receives a diametrically smaller, frictionally and interferingly interior mushroom-type head formed from a second of the respective edge portions and formed with an interior hollow within the interior head. In alternative configurations, the clinch joint may also be formed with a spot adhesive that is also releasable. In yet other variations, any combination of the preceding embodiments may be used.

The mushroom-type head portion of the clinch joint is preferably created with, for purposes of illustration but not limitation, a pestle-type piston that may be selected to have an end element that is diametrically larger than a piston shaft and smaller than a cylindrically trapezoidal die recess that is sized to receive the respective press drawn edge portions and the piston during the press drawing process. More specifically, the die recess is sized to accommodate the outer diameter of the exterior clinch joint head. In this arrangement, the adjacent respective edge portions are then press drawn into the recess whereby the drawn portions expand once fully pressed therein.

The clinch joint may also be formed by the press drawing process that presses together the two respective edge portions of the respective flashing sections, and draws together a small part of the respective edge portions with the pestle-type piston into the die recess. Then, an expander mechanism of the pestle may be preferably used that is diametrically expanded into the recess to form the clinch joint. Lastly, the expander is diametrically contracted and the pestle-type piston is withdrawn. An ejector base positioned within the die recess may be used to eject the formed clinch joint from the recess.

The flashing assembly according to the present invention also preferably contemplates the sheet material to be selected from the group of materials including, for example, powdered, machined, drawn, stamped, rolled, extruded, and forged metals and plastics, and alloys, and combinations, mixtures, compositions, hybrids, tempers, hardness modified, and heat treated variations thereof. More preferably, the sheet material is selected from a rolled, extruded, or stamped sheet material. Also, it is desirable that the sheet material be selected from the group of materials that includes materials that substantially resist damage due to exposure to the elements and weather. Additionally, it is preferred that the sheet material be resistant to or at least minimizes galvanic corrosion, which results from use of the flashing assembly, when formed from various metals, with fasteners that are made from metallic materials that are dissimilar to that of the sheet material.

Such preferred sheet materials include, for purposes of illustration but not limitation, plastics such as acetal resins, delrin, fluorocarbons, polyesters, polyester elastomers, metallocenes, polyamides, nylon, polyvinyl chloride, polybutadienes, silicone resins, ABS (acrylonitrile, butadiene, styrene), polypropylene, liquid crystal polymers, combinations and mixtures and composites thereof, hybrids, hardness modified, heat treated, and reinforced combinations and mixtures and composites thereof. If any of such plastics are selected, the clinch joint according to the present invention may not only be mechanically and or adhesively formed, but may also be thermoformed using any of a variety of methods can employ ultrasonic, heat, and other energy sources to further strengthen the joint. Such preferred sheet materials also further include, for purposes of illustration but not limitation, metals such as aluminum, tin, bronze, copper, lead, stainless steel, galvanized metals, weather proofed metals, plastic coated metals, and alloys, combinations, mixtures, compositions, hybrids, tempers, surface treated, hardness modified, and heat treated variations thereof.

These variations, modifications, and alterations of the various preferred embodiments may be used either alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures, wherein like reference numerals and reference numerals with primes across the several drawings, figures, and views refer to identical, corresponding, or equivalent elements, features, and parts:

DETAILED DESCRIPTION OF THE INVENTION

The flashing assembly of the instant invention enables a significant advance in the state of the art of flashing that is adapted for use with constructing a roof for industrial, commercial, and residential structures. The preferred embodiments and described modifications and variations of the flashing assembly accomplish this by new and novel arrangements of elements that are configured in unique and novel ways and which demonstrate previously unavailable capabilities and with significantly improved convenience and reduced waste.

Figure 1:
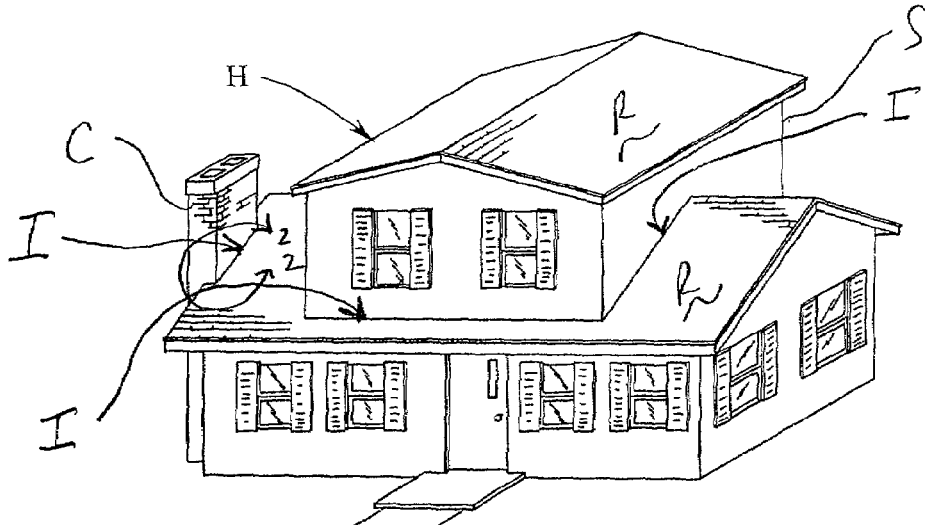
FIG. 1 is an elevated perspective view, in reduced scale, of a dwelling structure that is installed with a flashing assembly according to the present invention.
Figure 2:
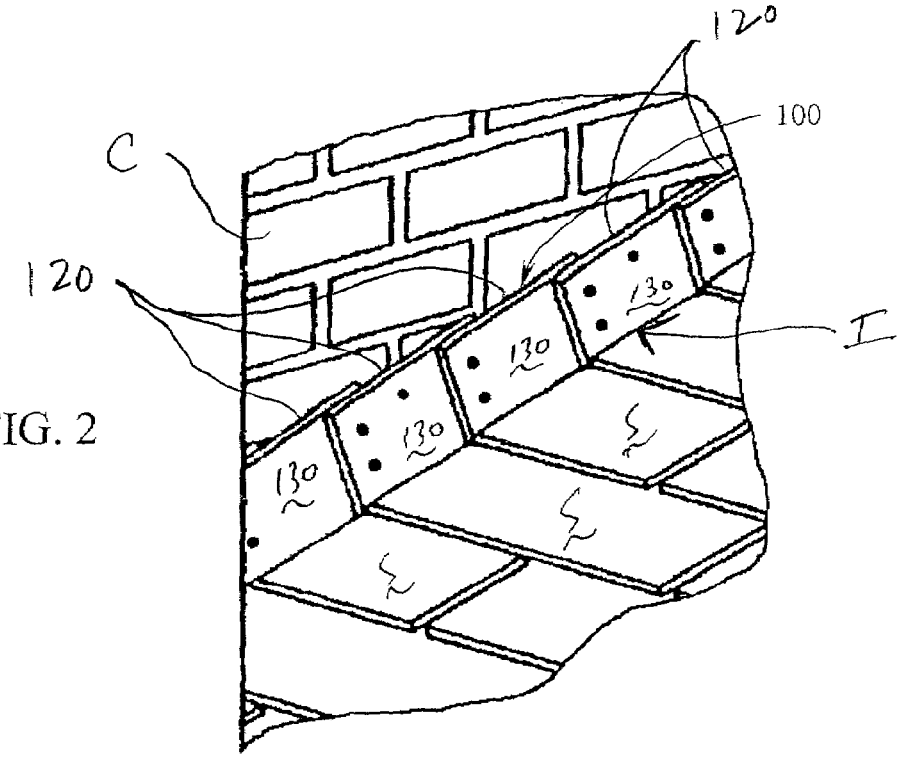
FIG. 2 is a detail view, enlarged scale and rotated, taken about line 2—2 of FIG. 1 of the dwelling structure and the flashing assembly of FIG. 1 with some structure removed for clarity.
Figure 3:
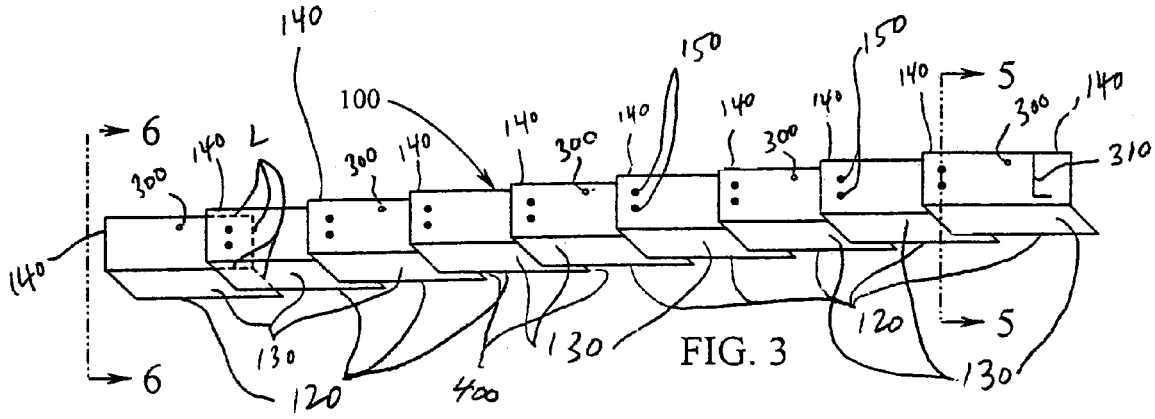
FIG. 3 is a perspective view, in modified scale, of the flashing assembly of FIGS. 1 and 2, and shown uninstalled and free-standing, and shown with partial hidden lines for purposes of clarification.
Figure 4:
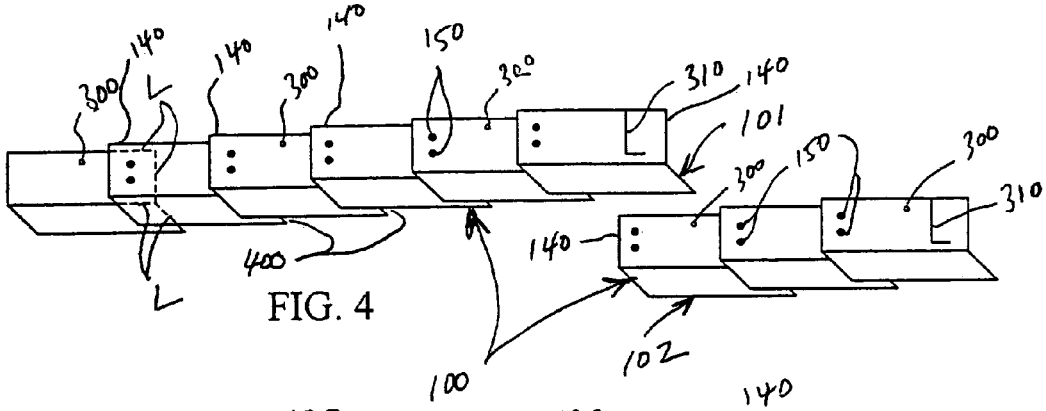
FIG. 4 is a perspective view of the flashing assembly of FIG. 3, shown partially disassembled.

With reference now to the accompanying figures and specifically to FIGS. 1–6, a flashing assembly 100 is described for use in the intersection joints I of a structure similar to house H of FIG. 1. The flashing assembly 100 is made from a plurality of overlapping flashing sections 120. As can be most easily understood with specific reference to FIGS. 3 and 4 with continued reference to the other figures, the overlapping relationship is established as depicted by the structure and the hidden lines labeled "L". Although the various figures depict 9 such sections 120 being connected together to form the flashing assembly, any suitable number of flashing sections 120 is contemplated for purposes of the instant invention.

Each of the sections 120 is preferably formed from a sheet material 130. Each section 120 is further formed to have opposite edge portions 140. The opposing edge portions 140 are preferably arranged about the flashing section 120 to establish a generally V-shaped configuration, as can be best understood with reference specifically to FIG. 6. Preferably, the V-shaped configuration is formed to have an inside angle, denoted in FIG. 6 by the arrow labeled with the reference symbol "θ" (the lowercase Greek alphabet character theta), that is between approximately 45 and 135 degrees, and is more preferably between approximately 60 degrees 120, and is most preferably approximately 90 degrees. Although not reflected in detail in the various figures, both a "left-handed" and a substantially mirror image "right-handed" version of the present invention is contemplated for use about the various intersections I of the roof R. Preferably, the overlapping edge portions 140 are flush and do not form any substantial interstice therebetween so as to minimize the possibility that moisture and other undesirable elements may accumulate. This is a significant advantage over prior art devices that intentional create a gap at this interface, which can lead to the accumulation of unwanted elements and subsequent leaks.

In the flashing assembly 100, the flashing sections 120 are joined together by at least one clinch joint 150 that is substantially formed upon the overlapping edge portions 140 of at least two different overlapping flashing sections 120. The clinch joint 150 is formed to have a different overlapping edge portion 140 of different respective flashing sections 120 to be registered proximate to and over one another to form the overlapping arrangement of edge portions 140. While the different, respective edge portions 140 are maintained in the overlapping relationship with one another, the clinch joint 150 is then created. The clinch joint 150 is preferably adapted to be releasable and to securing fasten the at least two sections 120 together. While secured, the respective flashing sections 120 are held together by the joint 150 until forcibly released by a user or installer of the flashing assembly 100. As will be understood by those with skill in the art, the clinch joint 150 also prevents relative movement of the individual flashing sections 120 with respect to one another once the assembly 100 has been installed. Therefore, fewer fasteners are required to attach the assembly 100 to the roofing structure. Additionally, in contrast to some prior art devices that included only an adhesive joint that is susceptible to cracking, deterioration, and subsequent shifting of the individual segments or cards, the device according to the present invention avoids such movement. Moreover, except otherwise noted with respect to the distinguishable adhesive joint of instant invention, without a sealing adhesive between edge portions 140, no interstice can form after the deterioration of and in the absence of the prior art adhesive. As a result, no unwanted moisture or other debris can accumulate between the edge portions 140.

Various modifications of the above-described flashing assembly embodiment 100 further can also preferably include one or more additional clinch joints 150. Such additional clinch joints 150 are also substantially arranged to cooperate with the first clinch joint 150 and are also preferably formed and registered upon the same overlapping edge portions 140 of the first clinch joint 150.

The present invention also further contemplates other modifications of the various preceding embodiments wherein the clinch joint 150 is preferably either a press fit joint as described by U.S. Pat. No. 5,115,897, or may be modified to further include adhesive within the joint, or some modification, combination, and/or permutation thereof. In such configurations, the clinch joint 150 may, in conjunction with being mechanically formed, be formed with a spot adhesive that is also releasable. In such additional variations and modifications, the clinch joint may be formed to have adhesive joints 160. The adhesive joints 160 may be formed in a process separate from the steps for forming clinch joint 150 that are described below or in conjunction therewith.

Figure 5:
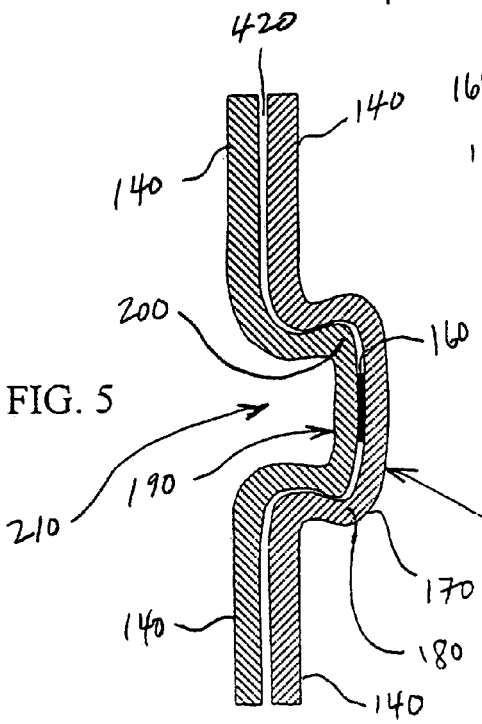
FIG. 5 is a partial section view, in enlarged scale, rotated, and with some structure removed for clarity, taken along section line 5—5 of FIG. 3.
Figure 6:
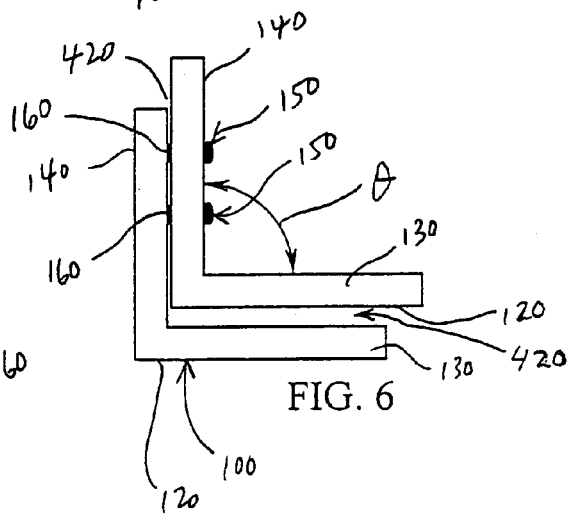
FIG. 6 is an end view, in enlarged scale and with some structure removed for clarity, of the flashing assembly of FIG. 3.

With reference next specifically to FIG. 5 in conjunction with the other figures, preferably, the clinch joint 150 is formed to have an exterior mushroom-type head 170 formed in a first of the respective edge portions 140, such as portion 180. The exterior mushroom head 170 is sized and shaped to receive a diametrically smaller, frictionally and interferingly interior mushroom-type head 190 that is formed from a second of the respective edge portions 140, such as portion 200. The interior mushroom head 190 is further formed to have an interior hollow 210 within the interior head 190.

Figure 7:
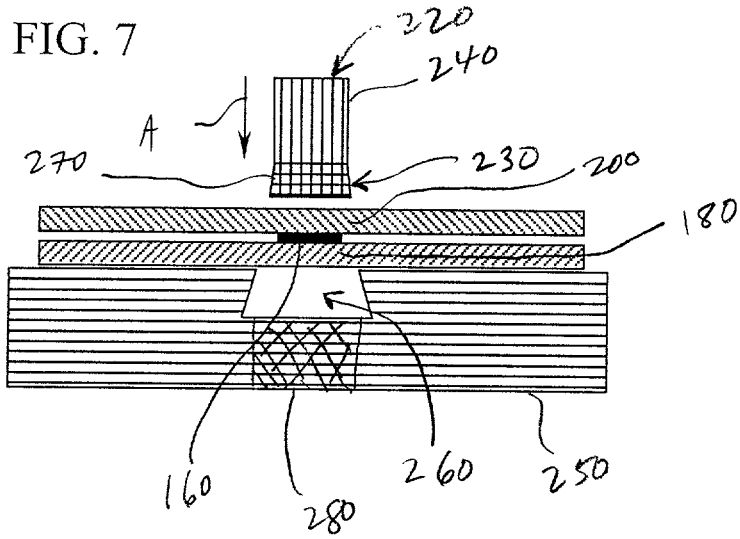
FIG. 7 is a partial section view, in reduced scale, of an assembly configured to create a variation of the clinch joint of the flashing assembly of FIGS. 1–5.
Figure 8:
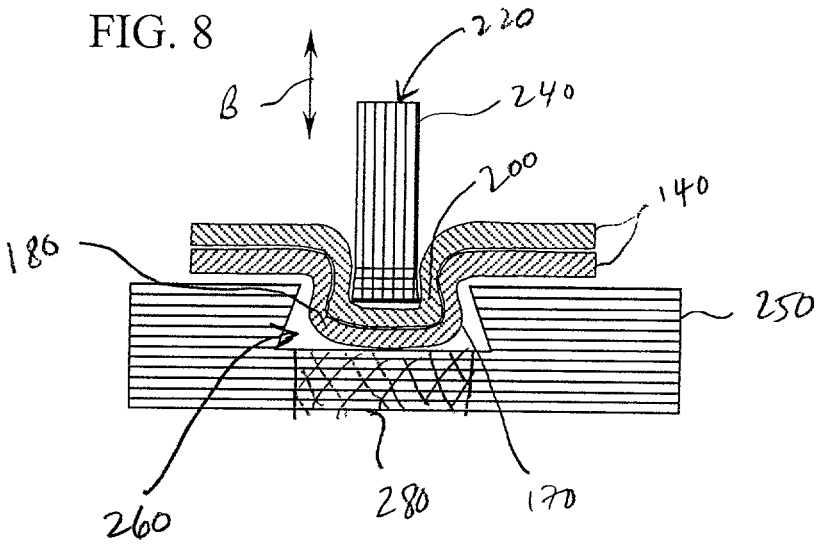
FIG. 8 is a partial section view, in reduced scale and with certain structure repositioned, of the clinch joint fabrication assembly of FIG. 7.
Figure 9:
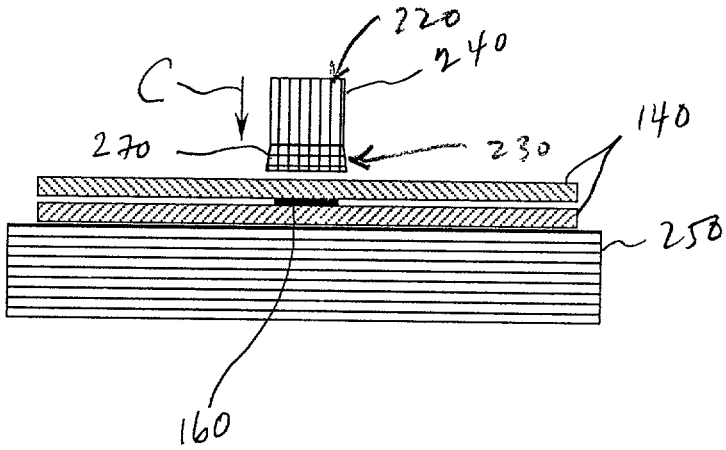
FIG. 9 is a partial section view, in reduced scale, of an assembly configured to create another variation of the clinch joint of the flashing assembly of FIGS. 1–5.

With continued reference to the previously described figures, reference is now also made to FIGS. 7, 8, and 9. The mushroom-type head portions 170, 190 of the clinch joint 150 are preferably created with, for purposes of illustration but not limitations, a pestle-type piston, such as, for example but not limitation, pestle-type piston 220. Although not required for certain configurations of the instant invention, the piston 220 can be preferably selected to have an end element 230 that may, for particular applications, be diametrically larger than a piston shaft 240. The piston 220 and end element 230 are adapted to cooperate with a die 250 that is preferably formed with a cylindrically trapezoidal recess 260 formed that is sized to receive the respective press drawn edge portions 180, 200 and the piston 200 during the press drawing process. More specifically, the die recess 260 is sized to accommodate the outer diameter of the exterior clinch joint head 170. In this arrangement, the adjacent respective edge portions 140 are then press drawn into the recess 260 whereby the drawn portions 180, 200 expand once full pressed therein (FIG. 8). In applications where a joint is to be formed without the mushroom head mechanical joint 150, then the arrangement reflected in FIG. 9 is particularly well suited for fabrication, and includes the manufacture of weld or adhesive joint 160. In applications that include the weld 160, the die 250 and pestle-type piston 220 may be further adapted as or with electrode voltage potential (not shown) that create the weld 160 upon formation of the joint upon contact as can be appreciated from FIG. 9, without the mechanical operation contemplated by FIG. 8.

The clinch joint 150 may also be formed by the press drawing process that presses together the two respective edge portions 140 of the respective flashing sections 120, and draws together a small part of the respective edge portions, such as portions 180, 200, with the pestle-type piston 220 them into the die recess 260 by movement indicated generally in FIGS. 7, 8, and 9 by the arrows labeled with reference letters "A", "B", and "C". Then, an expander mechanism, such as mechanism 270, of the pestle piston 220 may be preferably used that is diametrically expanded into the recess 260 to form the clinch joint 150. Lastly, the expander 270 is diametrically contracted and the pestle-type piston 220 is withdrawn, as can be understood with reference to the arrow labeled "B" in FIG. 8. An ejector base 280 positioned within the die recess 260 may be used to eject the formed clinch joint 250 from the recess 260.

In construction applications that are suited to the purpose, yet more variations of the preceding embodiments may further include one or more attachment holes, such as attachment holes or pilot holes 300. Although shown formed in every other flashing section 120 in FIGS. 3 and 4, such attachment/pilot holes 300 may also be formed in fewer or all of the sections 120 as may be suited to the particular preferences of the users and installers and the various construction applications. Moreover, more than one hole 300 may be incorporated into each section 120, if desired. Even if such holes are not deemed to be well-suited for particular construction application, those with skill in the art can appreciate that the flashing assembly of the present invention requires far fewer attachment fasteners since only enough are needed to attach the entire assembly 100 and since a fastener is not necessarily required in many applications for purposes of attaching each individual flashing section 120 to the roof structures.

Other modifications to any of the preceding embodiments also further may include one or more alignment indicia, such as end-to-end alignment indicia 310, which may be scored on the flashing section 120 or otherwise added by printing or other labeling methods that are known to those with skill in the art. Multiple types and styles of alignment indicia 310 may also be incorporated to facilitate convenience and depending on the particular application. For example, other indicia may be included to accommodate use of the flashing assembly 100 with various types of attachment fastening devices and methods and to accommodate various types of roofing material, such as roofing papers, tiles, shingles (denoted generally in FIG. 2 by reference letter "S") of all types of material, and shingle course alignment widths, methods, and styles. Furthermore, although not reflected in the figures, those with skill in the art can also understand that the alignment indicia 310 may also be added to either end of the individual flashing sections 120.

The flashing assembly 100 according to the present invention also preferably contemplates the sheet material 130 to be selected from the group of materials including, for example, powdered, machined, drawn, stamped, rolled, extruded, and forged metals and plastics, and alloys, and combinations, mixtures, compositions, hybrids, tempers, hardness modified, and heat treated variations thereof. More preferably, the sheet material 130 is selected from a rolled, extruded, or stamped sheet material. Also, it is desirable that the sheet material 130 be selected from the group of materials that includes those that are substantially resistant to deterioration and damage due to exposure to the elements and weather. Additionally, it is preferred that the sheet material 130 be resistant to or at least minimizes galvanic corrosion, which results from use of the flashing assembly, when formed from various metals, with fasteners that are made from metallic materials that are dissimilar to that of the sheet material. For example, if a tin or aluminum sheet material 130 is used with iron or steel nail fasteners that have been galvanized with zinc, then, after installation and over time and exposure to weather and the elements, the nail head and the portion of the sheet material 130 proximate to the attachment hole 300 in contact therewith may oxidize and disintegrate. Accordingly, for certain applications, a plastic or plastic coated sheet material 130 may be preferred that avoids the galvanic corrosion problems that may be more pronounced in especially wet and humid environments. Alternatively, an insulating material may be incorporated onto the sheet material 130 proximate to the attachment holes 300 to prevent the galvanic, cathodic, and anodic corrosion.

With this considerations in mind, such preferred sheet materials 130 also include, for purposes of illustration but not limitation, plastics such as acetal resins, delrin, fluorocarbons, polyesters, polyester elastomers, metallocenes, polyamides, nylon, polyvinyl chloride, polybutadienes, silicone resins, ABS (acrylonitrile, butadiene, styrene), polypropylene, liquid crystal polymers, combinations and mixtures and composites thereof, hybrids, hardness modified, heat treated, and reinforced combinations and mixtures and composites thereof. If any of such plastics are selected, the clinch joint 150 according to the present invention may not only be mechanically and or adhesively formed, but may also be thermoformed using any of a variety of methods that can employ, for example without limitation, ultrasonic, heat, and other energy sources to further strengthen the joint.

Such preferred sheet materials 130 also further include, for purposes of illustration but not limitation, metals such as aluminum, tin, bronze, copper, lead, stainless steel, galvanized metals, weather proofed metals, plastic coated metals, and alloys, combinations, mixtures, compositions, hybrids, tempers, surface treated, hardness modified, and heat treated variations thereof.

In operation, the sections 120 of the flashing assembly 100 are installed as can be understood with continued reference again to FIGS. 1 and 2, by positioning the flashing assembly 100 at intersections I and fastening the necessary sections 120 by screws or nails positioned and fixed into holes 300. Subsequent flashing assembly strips 100 are aligned, if necessary, using the alignment indicia 350. Roof covering articles, such as shingles S are inserted into interstices 400 (FIGS. 3, 4, and 6) as the shingle course is laid on and attached to the roof.

As an end of an intersection B is reached during installation of the flashing assembly 100, the excess flashing sections 120 may be removed for later use. This is accomplished by disconnecting the excess flashing sections 120 by using, for purposes of illustration but not limitation, the blade of the flat blade screw-driver that is inserted between the respective edge portions 140 to create the interstice labeled 420 (FIGS. 5 and 6) of overlapping flashing sections 120 and proximate to the clinch joint. Prior to inserting the blade of the screwdriver, the respective edge portions are preferably flush against one another as described above. The blade is then twisted to impart a separating force between sections 120 and edge portions 140 that is sufficient to cause the interior joint head 190 to pop out of the exterior joint head 170, and or to fracture and separate the spot weld 160 and or adhesive portion 160 of the joint 150.

Numerous alterations, modifications, and variations of the preferred embodiments disclosed herein will be apparent to those skilled in the art and they are all contemplated to be within the spirit and scope of the instant invention. For example, although specific embodiments have been described in detail, those with skill in the art will understand that the preceding embodiments and variations can be modified to incorporate various types of substitute and/or additional materials, relative arrangement of elements, and dimensional configurations for compatibility with the wide variety of roofing applications and flashing requirements available and in use in the construction industry. Accordingly, even though only few variations of the present invention are described herein, it is to be understood that the practice of such additional modifications and variations and the equivalents thereof, are within the spirit and scope of the invention as defined in the following claims.

I claim:

1. A flashing strip assembly, comprising;

a plurality of flashing sections formed from a sheet material to have a generally V-shaped configuration and opposite edge portions, each section being further formed with at least one attachment hole and at least one alignment indicium wherein each section of the plurality is adapted to be arranged to overlap with another section of the plurality about the edge portions; and at least two clinch joints formed in the edge portions of at least two of the flashing sections wherein the clinch joints are substantially registered on the overlapping edge portions and are thereby operative to releasably fasten the sections together.

2. The flashing assembly according to claim 1, wherein the v-shaped configuration incorporates an inside angle that is approximately 90 degrees.

3. The flashing assembly according to claim 1, wherein:

the sheet material is one selected from the group of materials consisting of powdered, machined, drawn, stamped, rolled, extruded, and forged metals and plastics.

4. The flashing assembly according to claim 3, wherein the plastic material is further selected from the group consisting of acetal resins, delrin, fluorocarbons, polyesters, polyester elastomers, metallocenes, polyamides, nylon, polyvinyl chloride, polybutadienes, silicone resins, ABS (acrylonitrile, butadiene, styrene), polypropylene, and liquid crystal polymers.

5. The flashing assembly according to claim 4, wherein the plastic material may be modified by at least one modification selected from the group consisting of hardness modified, heat treated, reinforced, or formed into a composite.

6. The flashing assembly according to claim 3, wherein the metal material is at least one selected from the group consisting of aluminum, steel, tin bronze, copper, lead, galvanized metals, weather proofed metals, plastic coated metals, and alloys thereof.

7. The flashing assembly according to claim 6, wherein the sheet material may be modified by at least one of the group consisting of tempering, hardness modifying, and heat treating.

8. The flashing assembly according to claim 1, wherein the clinch joint is a mechanical press fit interference joint.

9. A flashing strip assembly, comprising:

a plurality of flashing sections formed from a sheet material to have opposite edge portions arranged about a generally V-shaped configuration, wherein each section of the plurality is adapted to be arranged to overlap with another section of the plurality about respective edge portions; and at least two clinch joints formed in the edge portions of at least two of the flashing sections wherein the clinch joints are substantially registered on the overlapping edge portions and are thereby operative to releasably fasten the sections together.

10. The flashing assembly according to claim 9, wherein the V-shaped configuration incorporates an inside angle that is approximately 90 degrees.

11. The flashing assembly according to claim 9, wherein each of the flashing sections is further formed with at least one feature selected from the group including at least one attachment hole and at least one alignment indicium.

12. The flashing assembly according to claim 9, further comprising wherein:

the sheet material is at least one selected from the group of materials consisting of powdered, machined, drawn, stamped, rolled, extruded, and forged metals and plastics.

13. The flashing assembly according to claim 12, wherein the plastic material is one selected from the group consisting of acetal resins, delrin, fluorocarbons, polyesters, polyester elastomers, metallocenes, polyamides, nylon, polyvinyl chloride, polybutadienes, silicone resins, ABS (acrylonitrile, butadiene, styrene), polypropylene, and liquid crystal polymers.

14. The flashing assembly according to claim 13, wherein the plastic material may be modified by at least one modification selected from the group consisting of hardness modified, heat treated, reinforced, or formed into a composite.

15. The flashing assembly according to claim 12, wherein the metal material is at least one selected from the group consisting of aluminum, steel, tin, bronze, copper, lead, galvanized metals, weather proofed metals, plastic coated metals, and alloys thereof.

16. The flashing assembly according to claim 15, wherein the sheet material may be modified by at least one of the group consisting of tempering, hardness modifying, and heat treating.

17. The flashing assembly according to claim 9, wherein the clinch joint is a mechanical press fit interference joint.

18. A flashing assembly, comprising:

a plurality of overlapping flashing sections each formed from a sheet material to have opposite edge portions arranged about a generally V-shaped configuration; and at least one clinch joint substantially formed and registered upon overlapping edge portions of at least two of the plurality of overlapping flashing sections and adapted to releasably fasten the at least two sections together.

19. The flashing assembly according to claim 18, wherein at least a second clinch joint substantially formed and registered upon the same overlapping edge portions of the at least two flashing sections and adapted to releasably fasten the sections together.

20. The flashing assembly according to claim 18, wherein the V-shaped configuration incorporates an inside angle that is approximately 90 degrees.

21. The flashing assembly according to claim 18, wherein each of the flashing sections is further formed with at least one feature selected from the group consisting of at least one attachment hole and at least one alignment indicium.

22. The flashing assembly according to claim 18, wherein:

the sheet material is at least one selected from the group of materials consisting of powdered, machined, drawn, stamped, rolled, extruded, and forged metals and plastics.

23. The flashing assembly according to claim 22, wherein the plastic material is selected from the group consisting of acetal resins, delrin, fluorocarbons, polyesters, polyester elastomers, metallocenes, polyamides, nylon, polyvinyl chloride, polybutadienes, silicone resins, ABS (acrylonitrile, butadiene, styrene), polypropylene and liquid crystal polymers.

24. The flashing assembly according to claim 23, wherein the plastic material may be modified by at least one modification selected from the group consisting of hardness modified, heat treated, reinforced, or formed into a composite.

25. The flashing assembly according to claim 22, wherein the metal material is selected from the group consisting of aluminum, steel, tin, bronze, copper, lead, galvanized metals, weather proofed metals, plastic coated metals, and alloys therof.

26. The flashing assembly according to claim 25, wherein the sheet material may be modified by at least one of the group consisting of tempering, hardness modifying, and heat treating.

27. The flashing assembly according to claim 18, wherein the clinch joint is a mechanical press fit interference joint.

* * * * *